US012173908B2

(12) United States Patent
Cowan

(10) Patent No.: US 12,173,908 B2
(45) Date of Patent: Dec. 24, 2024

(54) IGNITER ASSEMBLY FOR A GAS COOKING APPLIANCE

(71) Applicant: Midea Group Co., Ltd., Foshan (CN)

(72) Inventor: Richard Cowan, Louisville, KY (US)

(73) Assignee: MIDEA GROUP CO., LTD., Guangdong (CN)

( * ) Notice: Subject to any disclaimer, the term of this patent is extended or adjusted under 35 U.S.C. 154(b) by 599 days.

(21) Appl. No.: 17/478,301

(22) Filed: Sep. 17, 2021

(65) Prior Publication Data

US 2022/0003417 A1 Jan. 6, 2022

Related U.S. Application Data

(63) Continuation of application No. 16/455,851, filed on Jun. 28, 2019, now Pat. No. 11,125,440.

(51) Int. Cl.
*F24C 3/10* (2006.01)

(52) U.S. Cl.
CPC ..... *F24C 3/103* (2013.01)

(58) Field of Classification Search
CPC ..... F24C 3/103
USPC ..... 126/39 E
See application file for complete search history.

(56) References Cited

U.S. PATENT DOCUMENTS

| | | | | |
|---|---|---|---|---|
| 2,850,084 A | | 9/1958 | Kunzler | |
| 3,812,324 A | | 5/1974 | Faffaelli et al. | |
| 4,176,903 A | | 12/1979 | Cairo et al. | |
| 4,177,034 A | | 12/1979 | Jones | |
| 4,337,029 A | | 6/1982 | McElroy et al. | |
| 4,572,154 A | | 2/1986 | Schweitzer | |
| 4,846,671 A | | 7/1989 | Kwiatek | |
| 4,861,264 A | | 8/1989 | Romanak et al. | |
| 4,943,232 A | | 7/1990 | Lin | |
| 5,040,970 A | | 8/1991 | Riehl | |
| 5,112,218 A | | 5/1992 | Sigler | |
| 5,125,390 A | | 6/1992 | Riehl | |
| 5,160,255 A | * | 11/1992 | Sigler | F24C 3/103 126/39 E |
| 5,622,672 A | | 4/1997 | Swick | |

(Continued)

FOREIGN PATENT DOCUMENTS

| | | |
|---|---|---|
| CN | 203190465 U | 9/2013 |
| CN | 203395956 U | 1/2014 |

(Continued)

OTHER PUBLICATIONS

International Search Report and Written Opinion issued in Application No. PCT/CN2020/097203, dated Sep. 30, 2020.

*Primary Examiner* — Avinash A Savani
(74) *Attorney, Agent, or Firm* — Gray Ice Higdon

(57) ABSTRACT

An igniter assembly for a gas cooking appliance is disclosed herein. In some embodiments, the igniter assembly may have an igniter that can be removed from and/or inserted into an igniter socket through a surface of a cooking appliance without having to remove the surface of the cooking appliance. Accordingly, when the surface is being cleaned after cooking applications, the igniter can be removed from the surface, thereby eliminating any potential damage to the igniter and allowing the surface to be thoroughly cleaned. After cleaning, the igniter can then be re-inserted into the igniter socket through the surface of the cooking appliance without having to remove the surface of the cooking appliance.

21 Claims, 8 Drawing Sheets

(56) References Cited

U.S. PATENT DOCUMENTS

| | | | | |
|---|---|---|---|---|
| 5,804,092 | A | 9/1998 | Axelson et al. | |
| 6,328,556 | B1 | 12/2001 | Somer | |
| 6,817,353 | B2 | 11/2004 | Atkinson et al. | |
| 8,973,569 | B2 | 3/2015 | Padgett et al. | |
| 2004/0200469 | A1* | 10/2004 | Atkinson | F24C 3/103 126/39 R |
| 2013/0199512 | A1 | 8/2013 | Cetintas | |
| 2013/0306055 | A1* | 11/2013 | Cadima | F24C 3/085 126/39 E |
| 2015/0010872 | A1 | 1/2015 | Schindler et al. | |
| 2017/0089585 | A1 | 3/2017 | Jeong et al. | |
| 2017/0328560 | A1 | 11/2017 | Medina et al. | |
| 2019/0301742 | A1 | 10/2019 | Sprowl et al. | |
| 2022/0099301 | A1 | 3/2022 | Cowan et al. | |

FOREIGN PATENT DOCUMENTS

| | | | |
|---|---|---|---|
| CN | 204830056 | U | 12/2015 |
| CN | 205619385 | U | 10/2016 |
| CN | 106152182 | A | 11/2016 |
| CN | 208886844 | U | 5/2019 |
| JP | H10238782 | A | 9/1998 |
| KR | 20010090284 | A | 10/2001 |

* cited by examiner

IGNITER ASSEMBLY FOR A GAS COOKING APPLIANCE

BACKGROUND

Cooktops, whether as standalone cooking appliances or incorporated into other cooking appliances such as ranges, generally incorporate multiple heating elements, generally referred to as burners, which are generally controlled by individual burner controls. Cooktop burners may be heated using various types of technologies, e.g., using natural gas, resistive electrical elements or inductive electrical elements, and while in some instances the cooktop burners may incorporate surfaces upon which pots and pans may be directly placed, in other instances the cooktop burners may be covered with grates or may be disposed below glass surfaces upon which pots and pans may be placed.

Generally, cooktop burners that utilize natural gas burners are more energy and cost effective when compared to their electrical and inductive counterparts. Further, natural gas burners provide superior control in terms of energy output for each of the cooktop burners as compared to their electrical and inductive counterparts, and, as a result, provide superior temperature control for each of the cooktop burners. Therefore, cooking appliances having natural gas cooktop burners are an attractive option for consumers.

Most cooktops that have natural gas burners utilize an igniter to generate a spark for a corresponding burner when a control signal to ignite the corresponding burner is received at a control panel of the cooktop appliance. Generally, the igniter for each corresponding burner remains in a fixed position on the cooktop surface to ensure the igniter generates the spark for the corresponding burner when the control signal is received. When in use, the cooktop surface is prone to becoming messy as food and various liquids often spill onto the cooktop surface during cooking applications. Accordingly, subsequent to being used, the cooktop surface is often cleaned to clear the cooktop surface of these foods and various liquids. However, it can be difficult to properly clean the cooktop surface in an area surrounding each of the igniters.

Moreover, the igniters can be damaged when the cooktop surface is being cleaned, thereby potentially rendering the corresponding cooktop burner useless until a new igniter is installed. Usually, the igniters are mechanically coupled to an orifice holder or to an underside of a corresponding burner and cannot be replaced without removing power from the cooktop appliance, removing the cooktop surface from the cooking appliance, disconnecting the wiring for the damaged igniter and/or other components connected to the damaged igniter, installing the new igniter, connecting the wiring for the new igniter and/or for the other components, placing the cooktop surface back on the cooking appliance, and applying power back to the cooktop appliance.

Accordingly, there is a need in the art for an improved igniter for a cooking appliance that allows for improved cleaning of the surface of the cooking appliance and eliminates the potential for damaging the igniter during cleaning without having to remove the cooktop surface.

SUMMARY

The herein-described embodiments address these and other problems associated with the art by providing an igniter assembly having an igniter that can easily be removed and/or inserted on a surface of a cooking appliance without having to remove the surface of the cooking appliance. The igniter assembly includes at least the igniter and an igniter socket. The igniter socket can be removably retained by a corresponding orifice holder and disposed beneath the surface of the cooking appliance along with the corresponding orifice holder. In some embodiments, the igniter may include an electrode pin extending through the igniter, and the electrode pin may include a first end and a second end. The igniter can be inserted through an aperture of the surface of the cooktop and into the igniter socket by pushing the second end of the electrode pin of the igniter through the aperture and into the igniter socket. Further, the igniter can be removed from the igniter socket by pulling the igniter out of the igniter socket and through the aperture of the surface of the cooking appliance. Notably, the igniter can be inserted into and/or removed from the surface of the cooktop assembly without having to remove the surface of the cooktop appliance and without having to use any sort of tool or fastener. Accordingly, the igniter assembly disclosed herein allows for improved cleaning of the surface of the cooking appliance and eliminates the potential for damaging the igniter during cleaning.

Therefore, consistent with one aspect of the invention, a cooking appliance is provided that includes a surface having an aperture. The surface of the cooking appliance is movable between an open position and a closed position, such that an interior of the cooking appliance is accessible when the surface of the cooking appliance is in the open position, and the interior of the cooking appliance is not accessible in the closed position. The cooking appliance further includes at least one orifice holder installed beneath the surface of the cooking appliance, where the at least one orifice holder has a first side and a second side. The cooking appliance further includes a burner assembly connected to the first side of the at least one orifice holder, where the burner assembly has a burner head and a burner cap. The cooking appliance further includes an igniter assembly having at least an igniter and an igniter socket. The igniter has an electrode pin extending through the igniter, and the electrode pin has a first end and a second end. The igniter socket has a first end and a second end and is removably retained by the at least one orifice holder. Further, the igniter is insertable through the aperture of the surface of the cooking appliance and into the first end of the igniter socket when the surface of the cooking appliance is in the closed position, and the igniter is removable from the aperture of the surface of the cooking appliance and the first end of the igniter socket when the surface of the cooking appliance is in the closed position.

In some embodiments, the igniter of the igniter assembly can further includes an igniter positioning flange that can be flush with the surface of the cooking appliance when the igniter is inserted through the surface of the cooking appliance and into the first end of the igniter socket when the surface of the cooking appliance is in the closed position. In some of those embodiments, when the igniter is inserted through the surface of the cooking appliance and into the first end of the igniter socket and when the surface of the cooking appliance is in the closed position, a first portion of the igniter can extend out of the aperture of the surface of the cooking appliance towards the burner cap of the burner assembly. In some further embodiments, the first end of the electrode pin can be maintained at a fixed position relative to the burner cap of the burner assembly to generate a spark upon receiving a control signal.

In some embodiments, the at least one orifice holder can include at least a first bracket and a second bracket. The first bracket of the orifice holder can include an aperture, and the second bracket of the orifice holder can include an opening and a slot. In some of those embodiments, the aperture of the first bracket can be disposed immediately below the aperture of the surface, and the igniter can be further insertable through the aperture of the first bracket and into the first end of the igniter socket when the surface of the cooking appliance is in the closed position. In some of those embodiments, the first end of the igniter socket can include a socket positioning flange, and the igniter socket can be insertable into an opening the second bracket, such that the socket positioning flange of the igniter socket can be flush with the second bracket when the igniter socket is inserted into the opening of the second bracket. In some further embodiments, the igniter socket can further include at least one rib, and the igniter socket can be removably retained, within the second bracket of the at least one orifice holder by a spring clip when the spring clip is inserted through the slot of the second bracket and around the at least one rib. In yet further embodiments, the spring clip can be inserted through the slot to removably retain the igniter socket when the surface of the cooking appliance is in the open position.

In some embodiments, the first end of the igniter socket can be tapered to guide the second end of the electrode pin into an interior of the igniter socket. In some of those embodiments, the interior of the igniter socket can be a female electrical connector, and a wire can be insertable into the second end of the igniter socket and removable from the second end of the igniter socket.

Consistent with another aspect of the invention, an igniter assembly for a cooking appliance is provided that includes an igniter having an igniter positioning flange and an electrode pin extending through the igniter. The electrode pin of the igniter has a first end and a second end, such that the second end of the electrode pin is insertable and removable through an aperture of a surface of the cooking appliance and a first bracket of an orifice holder. The igniter positioning flange is flush with the surface of the cooking appliance when inserted through the aperture of the surface and the first bracket. The igniter assembly further includes an igniter socket having a socket positioning flange and an interior. The igniter socket further has a first end and a second end, and the igniter socket is insertable into an opening of a second bracket of the orifice holder and removable from the opening of the second bracket of the orifice holder. The socket positioning flange is flush with the second bracket of the orifice holder when inserted into the opening of the second bracket, and, when the igniter is inserted through the surface of the cooking appliance and through the first bracket, the first end of the igniter socket receives the second end of the electrode pin of the igniter. The igniter assembly further includes a spring clip having an opening. The spring clip is insertable into a slot of the second bracket and removable from the slot of the second bracket to removably retain the igniter socket in the opening of the second bracket of the orifice holder, and, when the spring clip is inserted into the slot and around the igniter socket, the opening of the spring clip receives at least one rib of the igniter socket.

In some embodiments, the interior of the igniter socket can be an electrical connector, and the second end of the igniter socket can receive a wire that powers the electrical connector. In some embodiments, the second end of the electrode pin of the igniter can be inserted into the igniter socket by pushing the igniter through the aperture of the surface of the cooking appliance and through the first bracket of the orifice holder. In some of those embodiments, the second end of the electrode pin of the igniter can be removed from the igniter socket by pulling the igniter out of the aperture of the surface of the cooking appliance and out of the first bracket of the orifice holder. In some further embodiments, the second end of the electrode pin of the igniter can be inserted into and removed from the surface of the cooking appliance when the surface is in a closed position.

Consistent with yet another aspect of the invention, an igniter assembly for a cooking appliance is provided that includes a surface having an aperture, and the surface is movable between an open position and a closed position. The cooking appliance further includes at least one orifice holder installed beneath the surface of the cooking appliance. The at least one orifice holder further includes at least a first side and second side, and at least a first bracket and a second bracket, where the second bracket of the at least one orifice bracket has an opening and a slot. The cooking appliance further includes a burner assembly connected to a first side of the at least one orifice holder, where the burner assembly includes at least a burner head and a burner cap. The cooking appliance further includes an igniter assembly having at least an igniter, an igniter socket, and a spring clip. The igniter includes an electrode pin extending through the igniter, and the electrode pin has a first end and a second end. The igniter socket has a first end and a second end and is removably retained by the at least one orifice holder. The igniter socket is removably retained within the opening of the second bracket of the orifice holder when the spring clip is inserted into the slot. The igniter is insertable through the aperture of the surface of the cooking appliance, through the first bracket of the at least one orifice holder, and into the first end of the igniter socket when the surface of the cooking appliance is in the closed position, and the igniter is removable from the aperture of the surface of the cooking appliance and the first end of the igniter socket when the surface of the cooking appliance is in the closed position.

In some embodiments, the first bracket of the orifice holder can include an aperture disposed immediately below the aperture of the surface, the igniter can be further insertable through the aperture of the first bracket and into the first end of the igniter socket when the surface of the cooking appliance is in the closed position. In some embodiments, the second end of the electrode pin of the igniter can be inserted into the igniter socket by pushing the igniter through the aperture of the surface of the cooking appliance and the first bracket of the orifice holder. In some of those embodiments, the second end of the electrode pin of the igniter can be removed from the igniter socket by pulling the igniter out of the aperture of the surface of the cooking appliance and the first bracket of the orifice holder.

The term "cooking appliance" is used herein to refer to a standalone appliance or a combination of various appliances, such as an oven, over-the-range oven, cooktop, etc. A given cooking appliance may utilize various types of technologies for heating, such as natural gas, electric, and/or inductive. The term "cooktop appliance" is used herein to refer to a cooking appliance having a cooktop, whether standalone or in combination with another appliance (e.g., an oven having a corresponding cooktop). These terms are often used interchangeably herein.

The terms "open position" and "closed position" are used herein to refer to positions that a surface of a cooktop appliance may be placed. In an open position, a surface of a cooking appliance is removed from the cooking appliance such that various components are accessible (e.g., an orifice holder, portions of a burner assembly, gas lines, an outer surface of an oven housing, various heating elements, etc.). Generally, a surface of a cooking appliance is placed in an open position when one or more components of the cooking appliance are damaged and need to be repaired and/or replaced. In a closed position, a surface of a cooking appliance is installed on the cooking appliance and a cooktop is ready for use in cooking applications and various components are not accessible (e.g., an orifice holder, portions of a burner assembly, gas lines, an outer surface of an oven housing, various heating elements, etc.).

The term "orifice holder" is used herein to refer to an apparatus including one or more openings and can be installed, either permanently or temporarily, beneath a corresponding gas cooktop burner. A given orifice holder may have any one of a variety of enclosure/body arrangements and shapes, and/or mechanical, electrical connection, and thermal configurations, unless indicated otherwise. Various components, such as gas lines, burner assemblies, igniters, etc., may be connected to one or more openings on various sides of a given orifice holder.

The term "igniter" is used herein to refer to an apparatus, including one or more conductive elements and that can be retained, either permanently or temporarily, near a gas cooktop burner to create a spark between the igniter and the gas cooktop burner thereby igniting gas flowing to the gas cooktop burner. A given igniter may have any one of a variety of conductive elements (e.g., aluminum, copper, silver, etc.), enclosure/body arrangements and shapes, and/or electrical and mechanical connection configurations, unless indicated otherwise.

The term "igniter socket" is used herein to refer to an apparatus that can temporarily or permanently receive an igniter. A given igniter socket may be connected to one or more various components (e.g., an orifice holder and/or a burner assembly) beneath a surface of a cooking appliance, such that a given igniter socket is not accessible when the surface of the cooking appliance is in the closed position. A given igniter socket may have any one of a variety of electrical connectors (e.g., male, female, etc.), enclosure/body arrangements and shapes, and/or electrical and mechanical connection configurations, unless indicated otherwise. The term "igniter assembly" is used herein to refer to the combination of an igniter and an igniter socket, unless indicated otherwise.

These and other advantages and features, which characterize the invention, are set forth in the claims annexed hereto and forming a further part hereof. However, for a better understanding of the invention, and of the advantages and objectives attained through its use, reference should be made to the Drawings, and to the accompanying descriptive matter, in which there is described example embodiments of the invention. This summary is merely provided to introduce a selection of concepts that are further described below in the detailed description, and is not intended to identify key or essential features of the claimed subject matter, nor is it intended to be used as an aid in limiting the scope of the claimed subject matter.

Figure 1B:
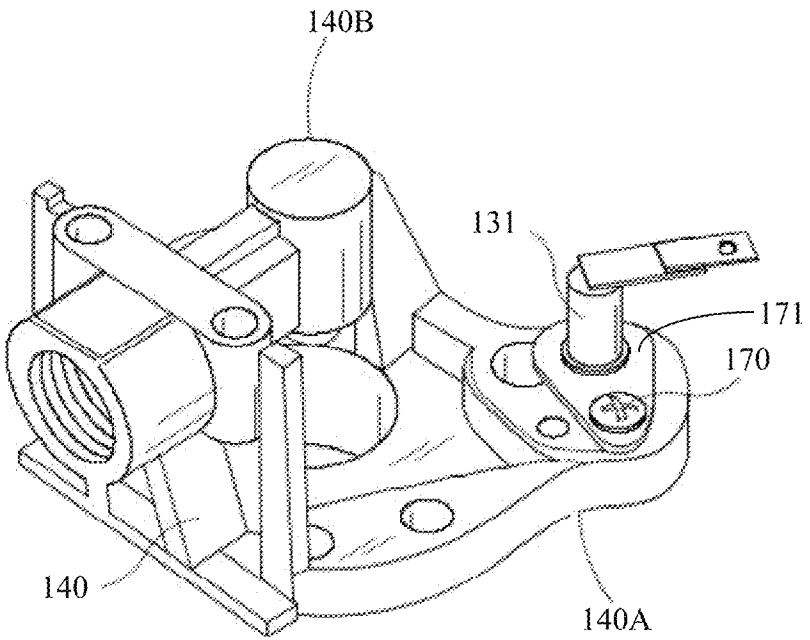
FIG. 1B PRIOR ART
FIGS. 1A and 1B are perspective views of various known igniters for cooking appliances that are fixed to an orifice holder.

It should be noted that the depicted embodiments are included herein for purposes of illustration and are not meant to be limiting. Various elements described throughout the drawings may be added, omitted, or re-arranged. Moreover, like numbers in the drawings and referenced throughout the detailed description denote like parts for the sake of brevity and should not be considered limiting.

DETAILED DESCRIPTION

A cooking appliance having a surface with one or more cooktop burners disposed thereon may be referred to as a cooktop appliance. Cooktop burners for these cooktop appliances may be heated using various types of technologies, e.g., using natural gas, resistive electrical elements or inductive electrical elements. In particular, for cooktop appliances that utilize natural gas cooktop burners, an igniter may be used to generate a spark to ignite gas flowing to a corresponding cooktop burner when a control signal to ignite the corresponding cooktop burner is received. Generally, the igniter for each corresponding cooktop burner remains in a fixed position on the surface of the cooktop appliance to ensure the igniter generates the spark for the corresponding cooktop burner when the control signal is received. Further, the surface of the cooktop appliance may be movable between an open position (i.e., various components installed beneath the surface of the cooktop appliance are accessible) and a closed position (i.e., the cooktop appliance is ready for use in normal operation and various components installed beneath the surface of the cooktop appliance are not accessible). Usually, the igniter cannot be removed unless the surface of the cooktop appliance is placed in the open position.

Figure 1A:
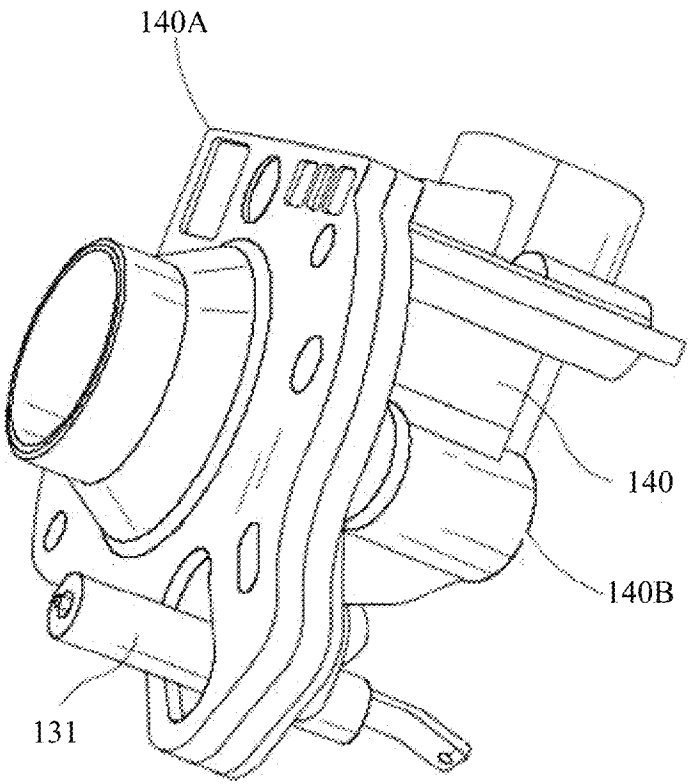
FIG. 1A PRIOR ART

For example, and as shown in prior art FIGS. 1A-1B, an igniter 131 can be fixed to an orifice holder 140. The orifice holder 140 can include a first side 140A and a second side 140B, and the igniter 131 can be fixed to the second side 140B of the orifice holder 140 using one or more fastening elements, e.g., a screw 170 and a mounting plate 171, a nut and a bolt, a pin and rod, or any other suitable fastening element(s). Although the cooktop appliance is not depicted in FIGS. 1A and 1B for the sake of clarity, the orifice holder 140 is generally installed beneath a surface of a cooktop appliance such that, when the orifice holder 140 is installed, the igniter 131 extends above the surface of the cooktop appliance, and remains in a fixed position on the surface of the cooktop appliance.

Figure 2:
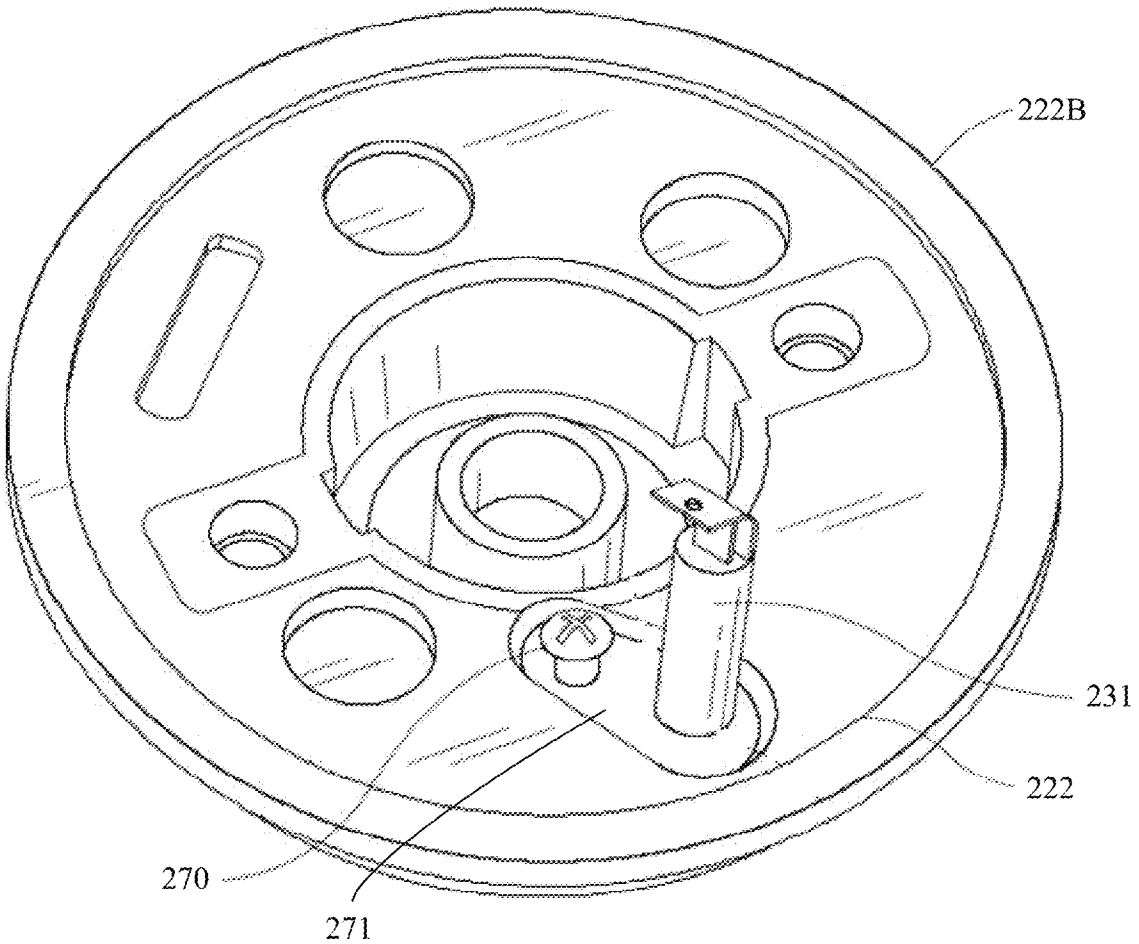
FIG. 2 PRIOR ART
FIG. 2 is a perspective view of another known igniter for a cooking appliance that is fixed to a burner head of a burner assembly.

As another example, and as shown in prior art FIG. 2, an igniter 231 can also be fixed to a burner head 222. The burner head 222 can include a first side (not depicted) and a second side 222B, and the igniter 231 can be fixed to the second side 222B of the burner head 222 using one or more fastening elements, e.g., a screw 270 and a mounting plate 271, a nut and a bolt, a pin and rod, or any other suitable fastening element. Although the cooktop appliance is not depicted in FIG. 2 for the sake of clarity, the burner head 222 is generally connected to an orifice holder (e.g., mechanically coupled to the first side 140A of the orifice holder 140 of FIGS. 1A and 1B) that is installed beneath a surface of a cooktop appliance such that, when the burner head 222 is connected to the orifice holder, the igniter 131 extends above the surface of the cooktop appliance, and remains in a fixed position on the surface of the cooktop appliance.

Notably, the igniters 131, 231 depicted in prior art FIGS. 1A-2 are fixed to various components that are installed beneath the surface of the cooktop appliance. However, if the igniters 131, 231 are damaged, then the igniters 131, 231 may not be able to generate a spark for a corresponding cooktop burner, thereby rendering the corresponding cooktop burner useless until the igniters 131, 231 are replaced. Moreover, an area surrounding the igniters 131, 231 may be difficult to clean since the igniters 131, 231 cannot be easily removed.

Accordingly, because the igniters 131, 231 are fixed to various components that are installed beneath the surface of the cooktop appliance, replacing the igniters 131, 231 can be a cumbersome and tedious task for an ordinary consumer and may require the help of an experienced technician. To replace the igniters 131, 231, the surface of the cooktop appliance is removed (i.e., placed in an open position), various components are disconnected and removed from the cooktop appliance (e.g., the orifice holder 140 of FIGS. 1A and 1B, or the burner head 222 of FIG. 2), the igniter 131, 231 can then be replaced, each of the disconnected components are re-installed beneath the surface of the cooktop appliance, and the surface of the cooktop appliance is re-installed on the cooktop appliance (i.e., placed in a closed position).

However, by using claimed apparatuses described herein (e.g., with respect to FIGS. 3A-6B), an igniter (e.g., igniter 331 described in FIGS. 3A-6A) can easily be inserted into and/or removed from a surface of a cooking appliance while cleaning the cooktop appliance, thereby enabling a user to more thoroughly clean the surface of the cooktop appliance and eliminating any potential damage to the igniter while cleaning. Notably, the apparatuses disclosed herein enable the igniter to be inserted into and/or removed from the surface of the cooking appliance without having to place the surface in the open position. Moreover, even if the igniter (e.g., igniter 331 described in FIGS. 3A-6A) is damaged while cleaning, this tedious and cumbersome process noted above can be eliminated due to the "plug and play" nature of the claimed apparatuses.

Figure 3A:
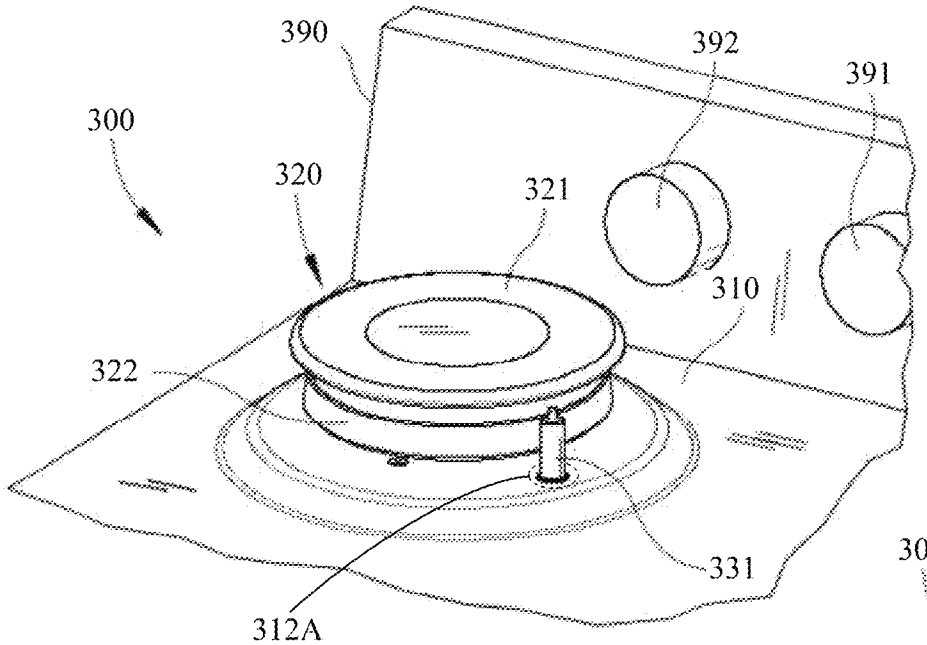
FIG. 3A is a perspective environmental view of a cooking appliance with an igniter inserted into a surface of the cooking appliance consistent with an embodiment of the invention.
Figure 3B:
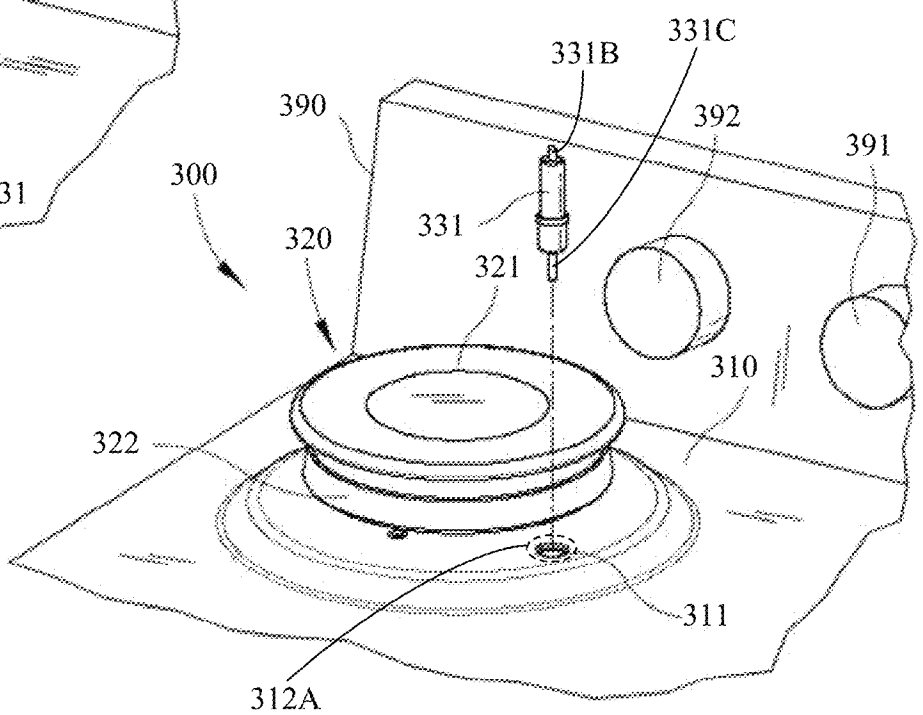
FIG. 3B is a perspective environmental view of the cooktop of FIG. 3A with the igniter removed from the surface of the cooking appliance consistent with an embodiment of the invention.

Turning now to FIGS. 3A and 3B, an environmental perspective view of a cooking appliance 300 (referred to hereinafter as "cooktop appliance 300") in which the various technologies described herein may be implemented. Various cooking elements (not shown in FIGS. 3A and 3B) may also be incorporated into the cooktop appliance 300, such as an oven, an over-the-range oven, etc., and utilize various types of technologies for heating (e.g., one or more of natural gas, electric, and/or inductive heating elements). The cooktop appliance 300 in these embodiments is a range oven that includes a cooktop surface 310 (referred to hereinafter as "surface 310"). The surface 310 of the cooktop appliance 300 may include an aperture 311.

Further, the surface 310 may be movable between an open position (not depicted) and a closed position (e.g., as depicted in FIGS. 3A-4B). When the surface 310 of the cooktop appliance 300 is in the closed position, the cooktop appliance 300 can be used for cooking applications and/or other applications. Although not depicted, the surface 310 of the cooktop appliance 300 can also be placed in an open position by, for example, removing one or more fastening elements connecting the surface 310 to the cooktop appliance 300 and sliding and/or lifting the surface 310 off of the cooktop appliance 300, actuating one or more pivoting mechanism that allow the surface 310 of the cooktop appliance 300 to pivot via one or more hinges, etc. When the surface 310 is in the open position, an area of the cooktop appliance 300 immediately beneath the surface 310 provides access to various components of the cooking appliance 300, such as an igniter socket 320 and an orifice holder 340 that are described in more detail herein (e.g., with respect to FIGS. 4A-5B).

Moreover, the cooktop appliance 300 may include a control panel 390 having various user interface devices, including, for example, control knobs 391, 392, for controlling energy output for each corresponding cooktop burner of the cooktop appliance 300, and a display (not depicted) for providing visual feedback as to the activation state of the cooktop appliance 300. It will be appreciated that the cooktop appliance 300 may include various types of user controls in other embodiments, including various combinations of switches, buttons, knobs and/or sliders, typically disposed at the rear or front (or both) of the cooktop appliance 300, although in some instances, user controls may be disposed at different locations, e.g., along the side of the cooktop appliance 300 or grouped near the center of the surface 310 of the cooktop appliance 300.

In the depicted embodiments of FIGS. 3A and 3B, the cooktop appliance 300 utilizes natural gas for heating each cooktop burner. Accordingly, the surface 310 of the cooktop appliance 300 can include at least one burner assembly 320 disposed thereon. The burner assembly 320 may include a burner cap 321 and a burner head 322. The burner cap 321 can rest upon or otherwise be removably retained by the burner head 322 (e.g., interference fit, rotatably mounted, etc.). Further, the surface 310 of the cooktop appliance 300 can removably retain an igniter 331. The igniter 331 can include an electrode pin 331A extending through the igniter 331, and the electrode pin 331A can have a first end 331B and a second end 331C. The igniter 331 can be inserted into and/or removed from the aperture 311 of the surface 310 of the cooking appliance 300. When the igniter 331 is inserted through the aperture 311 of the surface 310 of the cooking appliance 300, the first end 331B of the electrode pin 331 can be maintained in a fixed position relative to the burner cap 321 of the burner assembly 322.

Accordingly, upon receiving input via one or more user of the interface devices, e.g., via control knobs 391, 392, a gas valve (not depicted) may open and allow gas to flow from a manifold (not depicted) to the burner head 322 (e.g., via an orifice holder 340 as described in FIGS. 4A-5B). Further, as the gas valve opens, an electrical control signal can simultaneously be sent to the igniter 331, thereby generating a spark between the first end 331B of the electrode pin 331A of the igniter 331 and the burner cap 321. This spark can ignite the gas flowing from the manifold to the burner head 322 and can create a flame for a corresponding cooktop burner. After cooking is finished, further input via one or more of the interface devices, e.g., via control knobs 391, 392, can be received that stops the flow of gas from the manifold to the burner head 322, thereby extinguishing the flame for the corresponding cooktop burner. Although not depicted for the sake of clarity, the burner assembly 320 of the cooktop appliance 300 may be covered with one or more grates or another surface upon which pots and pans may be directly placed for cooking applications.

After cooking is finished and during cleaning of the surface 310, the igniter 331 can be removed from the aperture 311 of the surface 310 of the cooktop appliance 300, thereby allowing the surface 310 of the cooktop appliance 300 to be thoroughly cleaned and eliminating any potential damage to the igniter 331 while cleaning. The igniter 331 can be removed from the aperture 311 by simply pulling the igniter 331 out of the aperture 311, and the igniter 331 can be re-inserted into the aperture 311 by pushing the igniter 331 back through the aperture 311. For example, when cleaning the surface 310 of the cooktop appliance 300, one or more grates around each burner assembly can be removed, each corresponding igniter 331 can be removed from each corresponding aperture 311, and the surface 310 can be cleaned. After the surface 310 is cleaned, each of the corresponding igniters 331 can be re-inserted through the corresponding aperture 311 and the one or more grates around each burner assembly 320 can be placed back on the surface 310 of the cooktop appliance 300. Accordingly, the surface 310 of the cooktop appliance 300 can be cleaned without each of the igniters 331 interfering with cleaning of the surface 331 and without each of the igniters 331 being exposed to potential damage during cleaning. Notably, the igniter 331 can be inserted into and/or removed from the surface 310 of the cooktop appliance 300 without having to place the surface 310 of the cooktop appliance 300 in the open position.

Moreover, the surface 310 of the cooktop appliance 300, may further include a surface sealing mechanism 312A (depicted in FIGS. 3A and 3B as a dashed line for purposes of illustration) disposed immediately beneath the aperture 311 of the surface 310 of the cooktop appliance 300. In some embodiments, the surface sealing mechanism 312A may create a mechanical seal, such as a gasket seal (e.g., via an o-ring, captive o-ring assembly, etc.), a diaphragm seal (e.g., via a flexible membrane), etc., between the igniter 331 and the aperture 311 of the cooktop appliance 300. Accordingly, when the igniter 331 is inserted into the surface 331 and the cooktop appliance 300 is in use, the sealing mechanism 312A prevents foods and various liquids from entering the aperture 311 of the surface 310. In some of those embodiments, the surface sealing mechanism 312A may be flexible (e.g., a diaphragm seal), such that the surface sealing mechanism 312A also seals the aperture 311 when the igniter 331 is removed, thereby preventing cleaning solutions and/or other liquids from entering the aperture 311 of the surface 310. By including the surface sealing mechanism 312A, potential damage (i.e., caused by food, various liquids, and cleaning solutions) to the various components beneath the surface 310 of the cooktop appliance 300 (e.g., such as an orifice holder 340, an igniter socket 322, etc.) can be eliminated. Although not depicted, in some additional and/or alternative embodiments, the igniter 331 may also include a sealing mechanism (i.e., in addition to or in lieu of the surface sealing mechanism 312A) to reinforce the seal created between the igniter 331 and the aperture 311 of the cooktop appliance 300 by the surface sealing mechanism 312A.

Figure 4A:
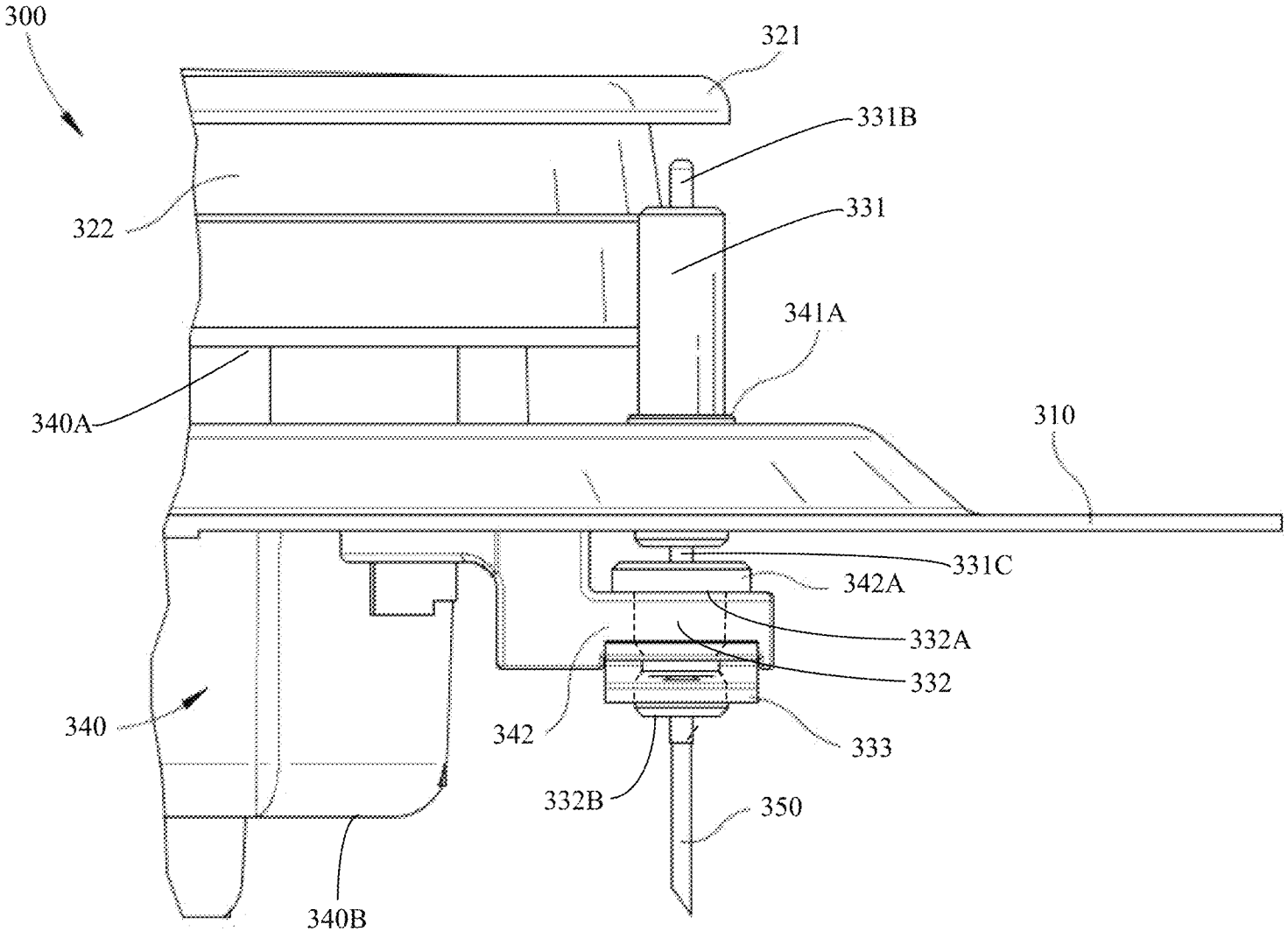
FIG. 4A is a side view of a cooking appliance with an igniter inserted into a surface of the cooking appliance consistent with an embodiment of the invention.
Figure 4B:
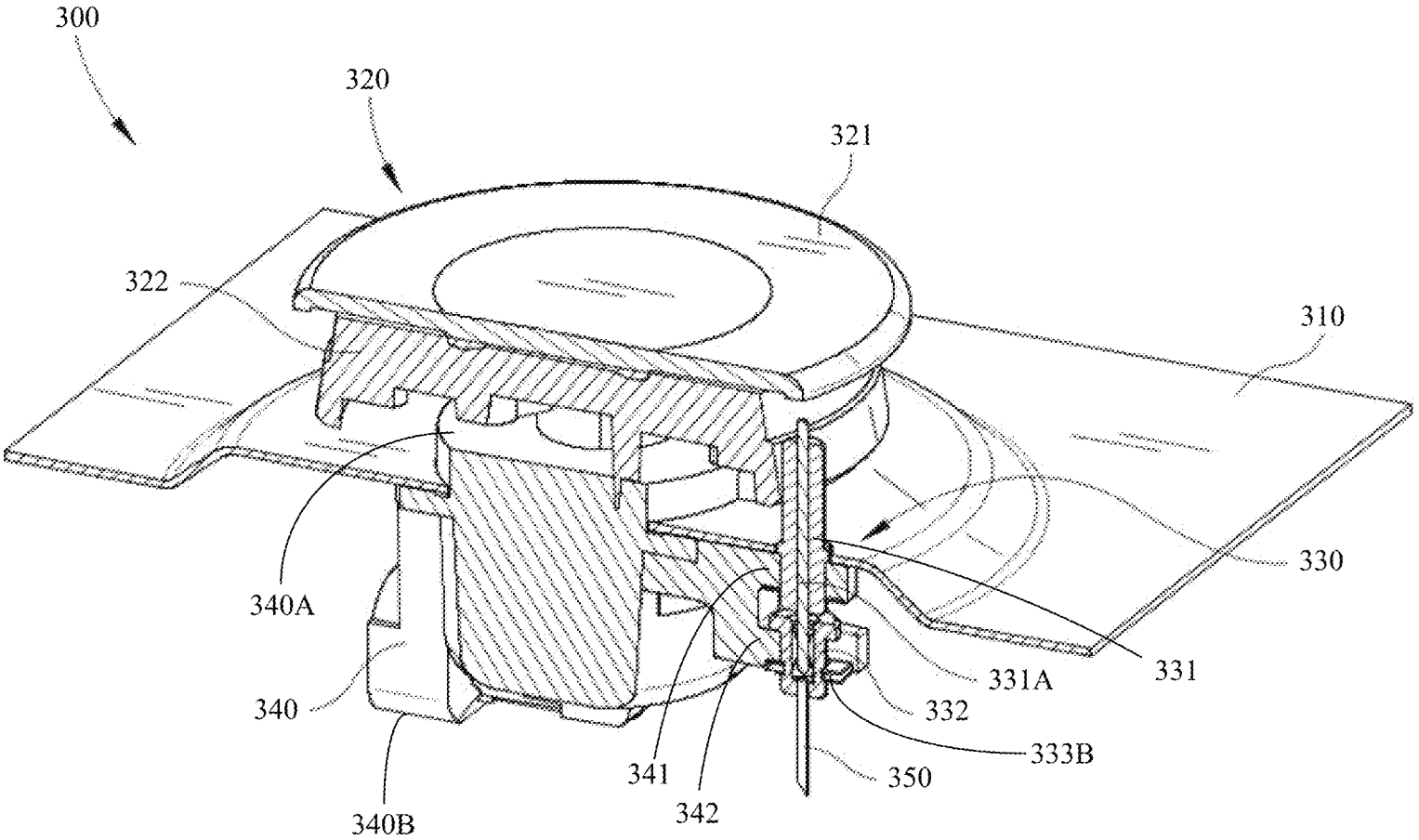
FIG. 4B is a cross-sectional perspective view of the cooking appliance of FIG. 4A with the igniter inserted into the surface of the cooking appliance consistent with an embodiment of the invention.

More particularly, and turning now to FIGS. 4A and 4B, when the igniter 331 is inserted through the aperture 311 of the surface 310 of the cooktop appliance 300, the second end 331C of the electrode pin 331A extending through the igniter 331 is received by the igniter socket 332 (indicated by dashed lines in FIG. 4A for purposes of illustration). The igniter socket 332 can include a first end 332A and a second end 332B, where the first end 332A of the igniter socket 332 can be configured to receive the second end 331C of the electrode pin 331A. In some embodiments, the igniter 331 may further include an igniter positioning flange 341A. The igniter positioning flange 341A ensures that, when the igniter 331 is inserted through the aperture 311 of the surface 310 of the cooktop appliance 300 and into the igniter socket 332, the first end 331B of the electrode pin 331A is maintained at a fixed position relative to the burner cap 321 of the burner assembly 320. Further, when the igniter 331 is inserted through the aperture 311 of the surface 310 of the cooktop appliance 300 and into the igniter socket 332, the igniter positioning flange 341A can be flush (i.e., level or parallel) with the surface 310 of the cooktop appliance 300. Additionally, the igniter positioning flange 341A can prevent the second end 331C of the electrode pin 331A from being inserted (e.g., pushed) too far into the igniter socket 332, thereby eliminating any risk of damaging the igniter socket 332 when inserting the igniter 331.

An orifice holder 340 can be disposed immediately below the surface 310 of the cooktop appliance 300 and have at least a first side 340A and a second side 340B. In some embodiments, a portion of the orifice holder 340 may protrude through surface 310 of the cooktop appliance 300, while in other embodiments, the entire orifice holder 340 may be disposed beneath the surface 310 of the cooktop appliance 300. The burner head 322 of the burner assembly 320 can be connected (e.g., using one or more fastening elements, using a friction fit between the burner head 322 and the orifice holder 340, etc.) to the first side 340A of the orifice holder 340 to control the gas flowing from the manifold to the burner head 322 when the input is received via one or more user interface devices, e.g., via control knobs 391, 392. In some embodiments, the orifice holder 340 can further include one or more brackets which are described in more detail herein (e.g., with respect to FIGS. 5A and 5B).

The second end 332B of the igniter socket 332 may be configured to receive a wire 350. As described herein (e.g., with respect to FIG. 6B), an interior of the igniter socket 332 can be an electrical connector 334A. When the igniter 331 is inserted through the aperture 311 of the surface 310 of the cooktop appliance 300 and into the igniter socket 332, the electrode pin 331A can be electrically coupled to the wire 350 via the electrical connector 334A. This connection is clearly illustrated in FIG. 4B as the electrode pin 331 extends through the igniter 331 and into the igniter socket 332. Accordingly, when the input is received via one or more user interface devices, e.g., via control knobs 391, 392, the electrical control signal is sent through the wire 350 to the electrical connector 334A of the igniter socket 332 and transferred to the electrode pin 331A, thereby generating the spark between the first end 331B of the electrode pin 331A of the igniter 331 and the burner cap 321 to ignite gas flowing to the burner assembly 320 via the orifice holder 340.

Figure 5B:
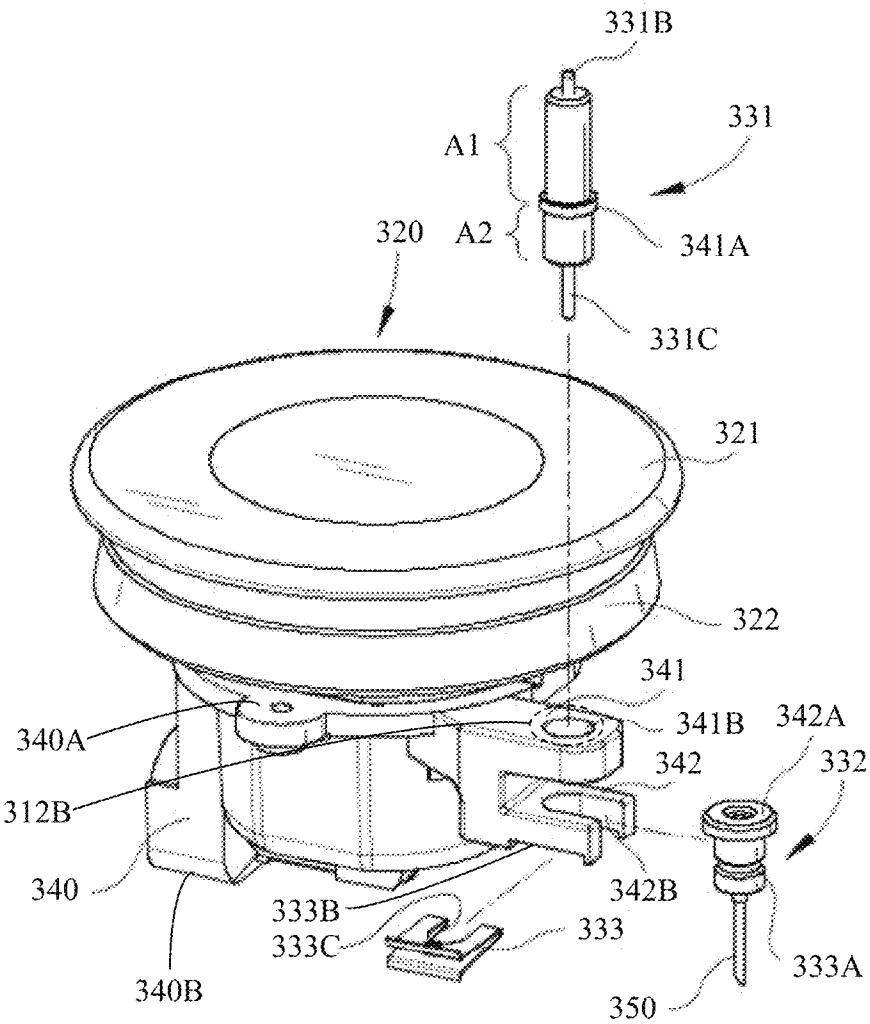
FIGS. 5A and 5B are perspective views of a burner assembly, an igniter assembly, and an orifice holder for a cooking appliance consistent with an embodiment of the invention.
Figure 5A:
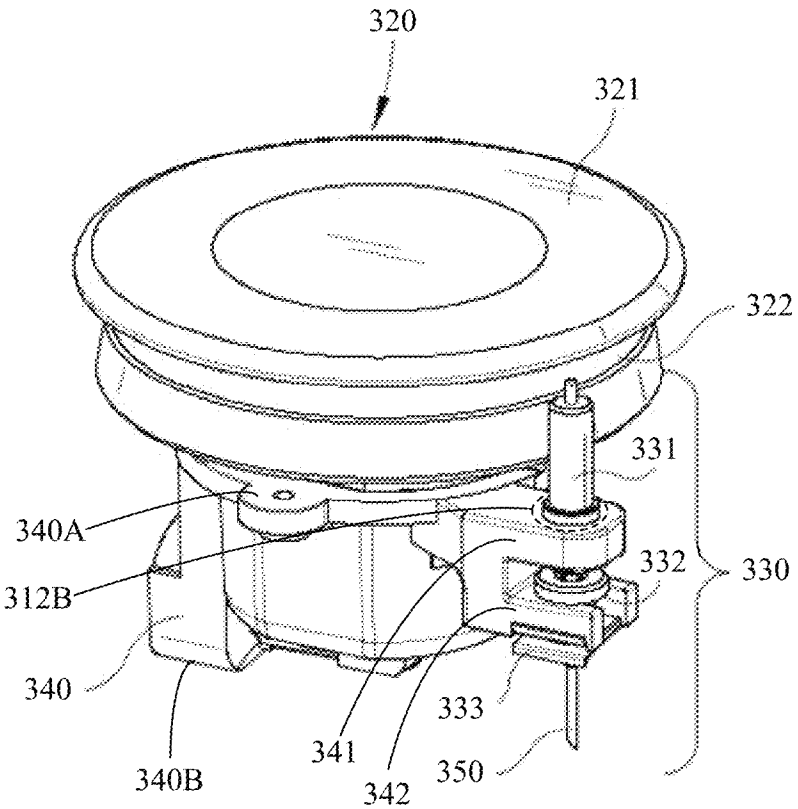

Turning now to FIGS. 5A and 5B, the burner assembly 320 (e.g., the burner cap 321 and the burner head 322), the igniter assembly 330 (e.g., at least the igniter 331 and the igniter socket 332), and the orifice holder 340 are depicted. Although these embodiments are depicted as being independent of the cooktop appliance 300, that is for the sake of clarity and not meant to be limiting. In some embodiments, and as noted above with respect to FIGS. 4A and 4B, the orifice holder 340 may further include one or more brackets, such as a first bracket 341 and a second bracket 342. In some of those embodiments, the first bracket 341 of the orifice holder 340 can have an aperture 341A that, when the orifice holder 340 is installed beneath the surface 310 of the cooktop appliance 300, is disposed immediately beneath the aperture 311 of the surface 310. In some further embodiments, the first bracket 341 may also include an orifice sealing mechanism 312B (depicted in FIGS. 5A and 5B as a dashed line for purposes of illustration) disposed above and/or within the aperture 341B of the first bracket 341.

Accordingly, when the second end 331C of the electrode pin 331A is inserted through the surface 310 of the cooktop appliance 300 when the surface 310 is in the closed position, the second end 331C of the electrode pin 331A is also inserted through the aperture 341B of the first bracket 341. The aperture 341B of the first bracket 341, in addition to the aperture 311 of the surface 310 and the igniter positioning flange 341A, helps guide the igniter 331 into the first end 332A of the igniter socket 332. Both the aperture 311 of the surface and the aperture 341A of the first bracket can have a similar diameter and/or slightly larger compared to that of the igniter 331, such that when the igniter 331 is inserted through the apertures 311, 341B, a friction fit is formed between the igniter 331 and each of the apertures 311, 341B.

Further, the orifice sealing mechanism 312B can create a mechanical seal, such as a gasket seal (e.g., via an o-ring, captive o-ring assembly, etc.), a diaphragm seal (e.g., via a flexible membrane), etc., between the igniter 331 and the aperture 341B of the first bracket 341. If included, the orifice sealing mechanism 312B can function similarly to the surface sealing mechanism 312A disposed immediately beneath the aperture 311 of the cooktop appliance 300, and the orifice sealing mechanism 312B can be in addition to or in lieu of the surface sealing mechanism 312A. For example, when the igniter 331 is inserted into the igniter socket 332 the surface 331 and the cooktop appliance 300 is in use, the orifice sealing mechanism 312B prevents any food and/or various liquids from passing the aperture 341B of the first bracket 341. Moreover, the orifice sealing mechanism 312B may be flexible (e.g., a diaphragm seal), such that the orifice sealing mechanism 312B also seals the aperture 341B when the igniter 331 is removed, thereby preventing cleaning solutions and/or other liquids from entering the aperture 341B of the first bracket 341. By including the orifice sealing mechanism 312B, potential damage (i.e., caused by food, various liquids, and cleaning solutions) to the various components beneath the surface 310 of the cooktop appliance 300 (e.g., such as an orifice holder 340, an igniter socket 322, etc.) can be eliminated.

In some embodiments, the second bracket 342 of the orifice holder 340 can include an opening 342B and a slot 333B. Further, the opening 342B of the second bracket 342 may be configured to removably retain the igniter socket 332. The igniter socket 332 can be inserted into the opening 342B of the second bracket 342 (e.g., by sliding igniter socket 332 into the opening 342B of the second bracket 342 when the surface 310 of the cooktop appliance 300 is in the open position or prior to installing the orifice holder 340 when the surface 310 of the cooktop appliance 300 is in the open position). In some embodiments, the igniter socket 332 may further include a socket positioning flange 342A and at least one rib 333A. As the igniter socket 332 is inserted into the opening 342B of the second bracket 342, the socket positioning flange 342A can slide along the second bracket 342, such that when the igniter socket 332 is fully inserted into the opening 342B of the second bracket 342, the socket positioning flange 342A can be flush (i.e., level or parallel) with the second bracket 342.

In some embodiments, after the igniter socket 332 is inserted into the opening 342B of the second bracket 342, a spring clip 333 can be inserted into the slot 333B. The spring clip 333 can also include an opening 333C, such that when the spring clip 333 is inserted into the slot 333B of the second bracket 342, the opening 333C of the spring clip 333 receives the at least one rib 333A of the igniter socket 332, thereby retaining the igniter socket 332 within the second bracket 342. In these embodiments, the igniter socket 332 cannot be removed while the spring clip 333 is inserted into the slot 333B of the second bracket 342 due to the rib 333A of the igniter socket 332 being retained and/or surrounded by the opening 333C of the spring clip 333. Although the depicted embodiments of FIGS. 5A and 5B include the spring clip 333, it should be noted that the spring clip 333 is not required. In some other embodiments, the igniter socket 332 can simply be inserted into the opening 342B of the second bracket 342 and the spring clip 333 can be omitted altogether. In some alternative embodiments, the igniter socket 332 can be fixed within second bracket 342 by one or more fastening elements, e.g., a screw, a nut and bolt, etc. In yet further embodiments, one or more latches and/or other fastening elements may be used to retain the igniter socket 332 within the second bracket 342 of the orifice holder 340.

However, during normal operation of the cooking appliance, the igniter socket 332 is usually removably retained by the second bracket 342 of the orifice holder 340 and not accessible when the surface 310 of the cooktop appliance 300 is in the closed position (i.e., because the orifice holder 340 is only accessible when the surface 310 of the cooktop appliance 300 is in the open position). Accordingly, even though the igniter socket 332 is not accessible when the surface 310 of the cooktop appliance 300 is in the closed position, the igniter 331 can still be inserted into the igniter socket 332 when the surface 310 is in the closed position by pushing the second end 331C of the electrode pin 331A through the aperture 311 of the surface 310, through the aperture 341B of the first bracket 341, and into the igniter socket 332. Moreover, the igniter 331 can still be removed from the igniter socket 332 by pulling the igniter 331 out of the aperture 311 of the surface 310, through the aperture 341B of the first bracket 341, and out of the igniter socket 332.

In the depicted embodiment of FIG. 5A, the igniter socket 332 can be removed from the second bracket 342 by removing the igniter 331, placing the surface 310 of the cooktop appliance 300 in the open position, removing the wire 350 from the igniter socket 332, removing the spring clip 333 from the slot 333B (e.g., by pulling the spring clip 333 out of the slot 333B), and sliding the igniter socket 332 out of the opening 342B of the second bracket 342. In other embodiments, the igniter socket 332 may be permanently connected to the orifice holder 340, and the orifice holder 340 may also need to be replaced when the igniter socket 332 is damaged, but the igniter 331 can still be inserted into and/or removed from the igniter socket 332. Regardless, if a component of the igniter assembly 330 (e.g., the igniter 331 or the igniter socket 332) is damaged, each of the components can be individually replaced depending on which portion of the igniter assembly 300 is damaged, thereby providing a "plug and play" igniter assembly 330 for the cooktop appliance 300.

Figure 6A:
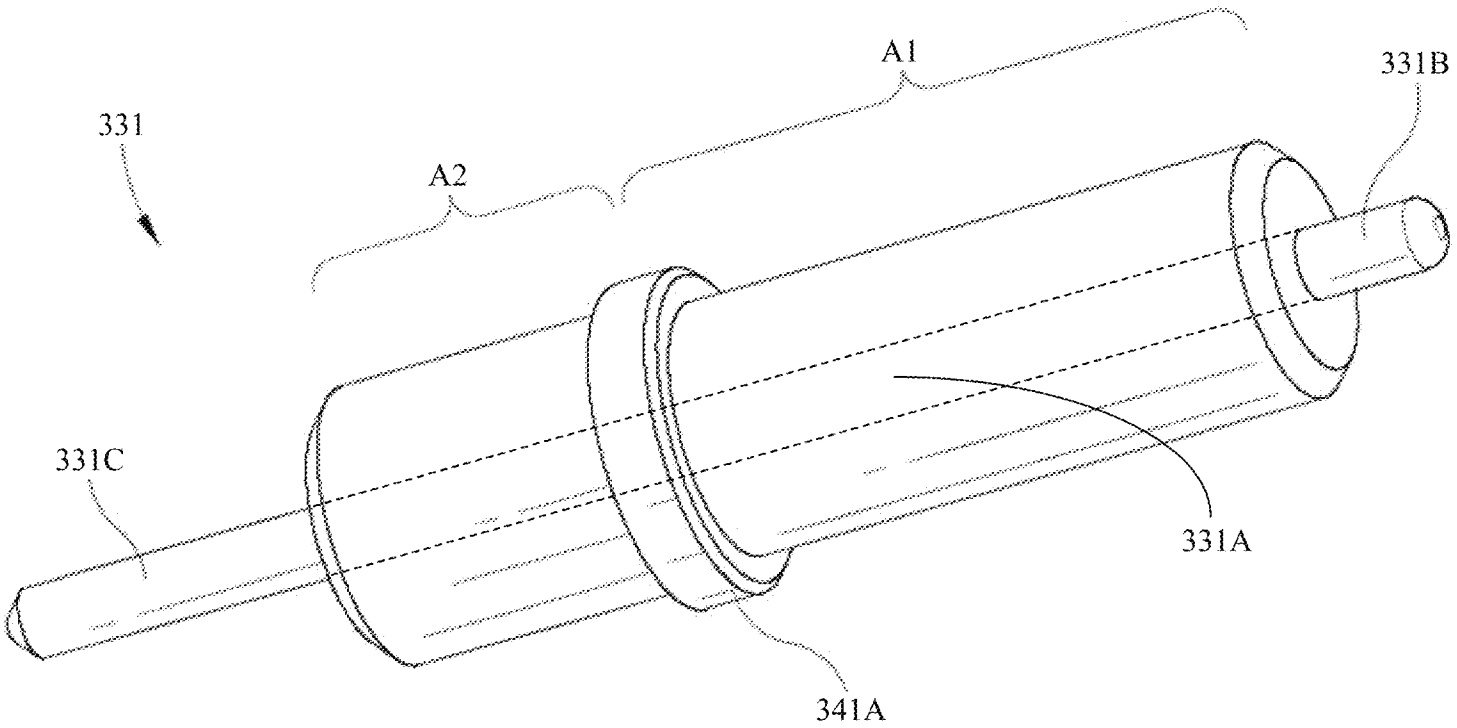
FIG. 6A is a perspective view of an igniter of an igniter assembly for a cooking appliance consistent with an embodiment of the invention.
Figure 6B:
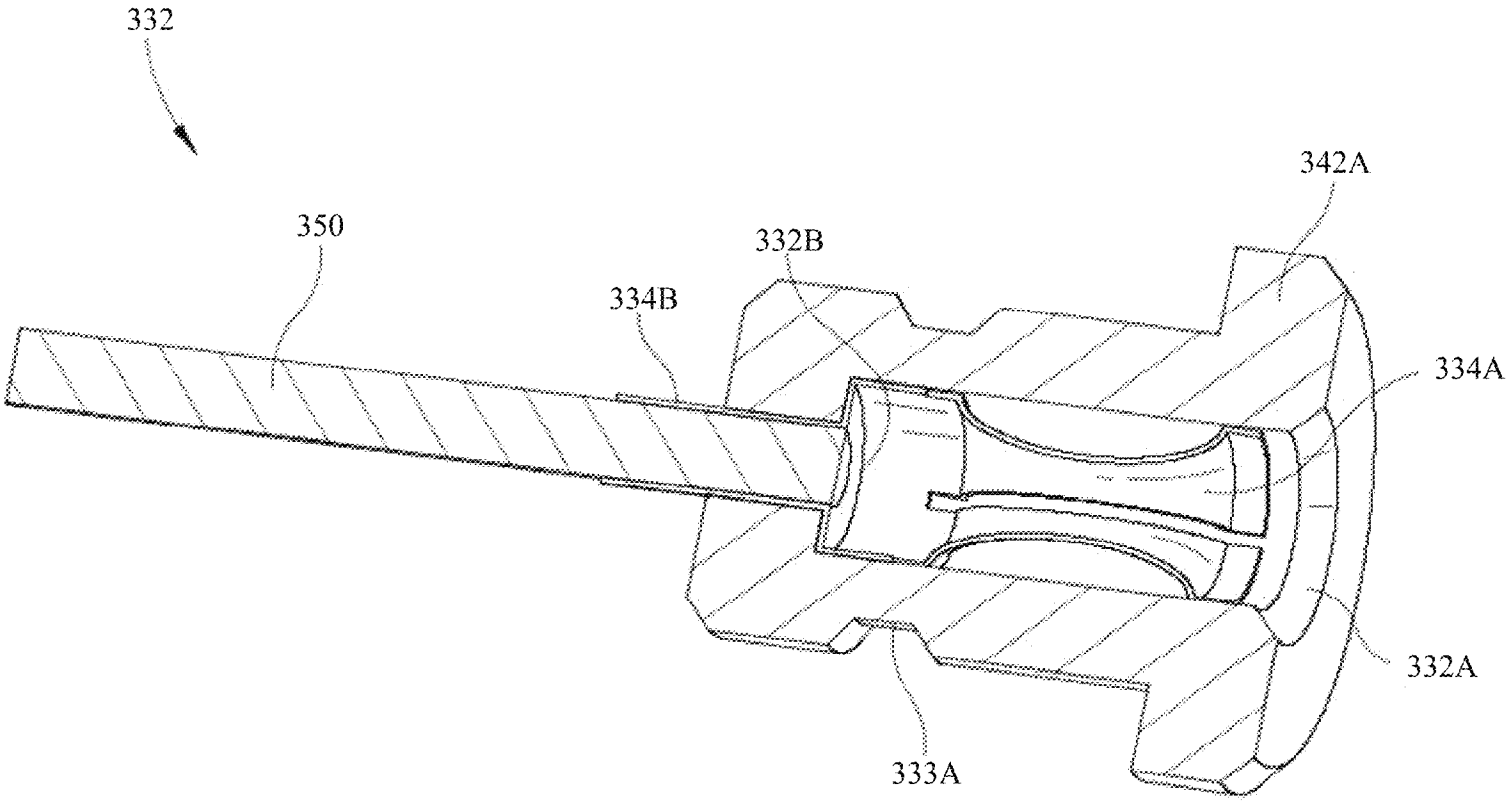
FIG. 6B is cross-sectional perspective view of an igniter socket of an igniter assembly for a cooking appliance consistent with an embodiment of the invention.

Aspects of the igniter assembly 330 (e.g., the igniter 331 or the igniter socket 332) are depicted in more detail in FIGS. 6A and 6B. As described herein (e.g., with respect to FIGS. 3A-5B), the igniter 331 includes the electrode pin 331A (indicated by dashed lines in FIG. 6A for purposes of illustration) that extends through the igniter 331 and that includes the first end 331B of the electrode pin 331A and the second end 331C of the electrode pin 331A. The igniter 331 may include a first portion A1 and a second portion A2. In particular, the igniter 331 can be inserted into the cooking appliance 300 by grabbing the igniter 331 by the first portion A1 and inserting (e.g., by pushing) the second portion A2 and the second end 331C of the electrode pin 331A through the aperture 311 of the surface 310 of the cooking appliance 300, through the aperture 341B of the first bracket, and into the igniter socket 332 until the igniter positioning flange 341A is flush with the surface 310 of the cooking appliance 300. Further, the igniter 331 can be removed from the cooking appliance 300 by grabbing the first portion A1 of the igniter and removing (e.g., by pulling) the first portion A1 of the igniter, thereby disengaging the second end 331C of the electrode pin 331A from the igniter socket 332. Notably, the igniter 331 can be removed from and/or inserted into and out of the cooktop appliance 330 without the use of any tools or fasteners.

In some embodiments, the first portion A1 and the second position A2 of the igniter 331 can be defined in part by a location of the igniter positioning flange 341A. In various embodiments, a position of the igniter positioning flange 341A can change. However, an amount of change in the position of the igniter positioning flange 341A may be subject to several constraints. For example, a constraint can be that a position of the first end 331B of the electrode pin 331A must be maintained relative to the burner cap 321 of the burner assembly 320 to ensure the cooktop appliance 300 functions properly. As another example, a constraint can be that the igniter positioning flange 341A ensures the second end 331C of the electrode pin 331A is inserted into the first end 332A of the igniter socket 332 to ensure a proper connection with the electrical connector 334A. Accordingly, when the igniter 331 is inserted into the igniter socket 332, the first portion A1 of the igniter 331 extends above the surface 310 of the cooktop appliance 300, and the second portion A2 of the igniter 331 extends below the surface 310 of the cooktop appliance 300, thereby ensuring proper positioning of the electrode pin 331A when the igniter 331 is inserted into the igniter socket 332.

Moreover, and as shown in FIG. 6B, when the igniter 331 is inserted into the igniter socket 332, the first end 332A of the igniter socket 332 is configured to receive the second end 331C of the electrode pin 331A. In some embodiments, the first end 332A of the igniter socket 332 includes an opening that can be tapered, chamfered, and/or beveled to help guide the second end 331C of the electrode pin 331A into an interior of the igniter socket 332. Further, the socket positioning flange 342A is located at the first end 332A of the igniter socket 332 and can be utilized while inserting the igniter socket 332 into the opening 342B of the second bracket 342 of the orifice holder 340. As noted above, in some embodiments, the igniter socket 332 can also include the at least one rib 333A. If included, the at least one rib 333A can be located around the igniter socket 332, such that the at least one rib 333A is received by the opening 333BC of the spring clip 333 when the spring clip 333 is inserted into the slot 333B of the second bracket 342 of the orifice holder 340. Further, if included, a position of the at least one rib 333A may vary as long as the at least one rib 333A is operable to be retained by the spring clip 333 when the spring clip 333 is inserted into the slot 333B of the second bracket 342 of the orifice holder 340.

In some embodiments, the interior of the igniter socket 332 can be and/or include the electrical connector 334A that is configured to receive the second end 331C of the electrode pin 331A. The wire 350 can be inserted into the second end 332B of the igniter socket 332, such that the second end 331C of the electrode pin 331A and the wire 350 are electrically coupled by the electrical connector 334A. In some embodiments, the second end 332B of the igniter socket 332 may also include a crimp socket 334B. The crimp socket 334B can be configured to receive the wire 350 and ensure the connection between the wire 350 and the electrical connector 334A is maintained over time and through normal wear and tear of the cooking appliance 300. Although the electrical connector 334A is depicted being female, that is not meant to be limiting. In alternative embodiments, the electrical connector 334A can be male, and the second end 331C of the electrode pin 331A can be configured to receive one or more components of a male electrical connector.

Upon receiving input via one or more user of the interface devices, e.g., via control knobs 391, 392, the electrical control signal can be sent to the igniter 331 by way of the igniter 331 being electrically coupled to the wire 350 via the electrical connector 334A, thereby generating a spark between the first end 331B of the electrode pin 331A of the igniter 331 and the burner cap 321. This spark can ignite the gas flowing from the manifold to the burner head 322 and can create a flame for a corresponding cooktop burner during cooking and/or other applications.

By providing an igniter assembly with an igniter that can be inserted into and/or removed from a surface of a cooking appliance while the surface is in a closed position, the surface of the cooktop can easily be cleaned and the potential for damaging the igniter can be eliminated. This also obviates the need for removing the surface of the cooking appliance to replace the igniter if it is damaged during cooking and/or cleaning.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It will be appreciated that various additional modifications may be made to the embodiments discussed herein, and that a number of the concepts disclosed herein may be used in combination with one another or may be used separately. Therefore, the invention lies in the claims hereinafter appended.

The invention claimed is:

1. A cooking appliance, comprising:

a cooktop having an aperture therethrough, the cooktop is movable between an open position and a closed position, wherein an interior of the cooking appliance is accessible in the open position, and wherein the interior of the cooking appliance is not accessible in the closed position;

at least one orifice holder positioned beneath the cooktop of the cooking appliance;

at least one burner;

at least an igniter and an igniter socket, the igniter being removably retained by the at least one orifice holder and includes an electrode pin extending through the igniter, and wherein the electrode pin includes a first end and a second end, and the igniter socket having a first end and a second end, wherein the first end of the igniter socket is a female electrical connector, and wherein a wire is electrically coupled to the second end of the igniter socket, wherein the igniter is insertable through the aperture of the cooktop of the cooking appliance and the second end of the electrode pin of the igniter is inserted into the female electrical connector of the igniter socket when the cooktop of the cooking appliance is in the closed position, wherein the igniter is removable from the aperture of the cooktop of the cooking appliance and the first end of the igniter socket when the cooktop of the cooking appliance is in the closed position, and wherein the first end of the igniter socket is tapered to guide the second end of the electrode pin into the female electrical connector of the igniter socket.

2. The cooking appliance of claim 1 wherein the igniter includes an igniter positioning flange.

3. The cooking appliance of claim 1 wherein the first end of the electrode pin is maintained at a fixed position relative to the at least one burner to generate a spark upon receiving a control signal.

4. The cooking appliance of claim 1 wherein the at least one orifice holder includes one or more brackets, wherein at least one of the one or more brackets include at least one of an aperture and a slot.

5. The cooking appliance of claim 1 wherein the wire is insertable into the second end of the igniter socket and removable from the second end of the igniter socket.

6. The cooking appliance of claim 1 wherein the first end of the igniter socket includes a socket positioning flange.

7. The cooking appliance of claim 1 wherein the igniter socket includes at least one rib, and wherein the at least one orifice holder includes a spring clip engaging the at least one rib.

8. The cooking appliance of claim 1 further comprising a sealing mechanism between the igniter and the aperture of the cooktop.

9. The cooking appliance of claim 1 wherein the burner includes a burner head and a cap.

10. An igniter assembly for a cooking appliance, comprising:

an igniter having an igniter positioning flange and an electrode pin extending through the igniter, the electrode pin of the igniter having a first end and a second end, wherein the second end of the electrode pin is insertable and removable through an aperture of a cooktop of the cooking appliance and a first bracket of an orifice holder, and wherein the igniter positioning flange stops downward travel when inserted through the aperture of the cooktop and the first bracket;

an igniter socket having a socket positioning flange and an interior, the igniter socket further having a first end and a second end, and the igniter socket being insertable into an opening of a second bracket of the orifice holder and removable from the opening of the second bracket of the orifice holder;

wherein, when the igniter is inserted through the cooktop of the cooking appliance and through the first bracket, the first end of the igniter socket receives the second end of the electrode pin of the igniter; and wherein the second end of the electrode pin of the igniter is inserted into the igniter socket by pushing the igniter through the aperture of the cooktop of the cooking appliance and through the first bracket of the orifice holder.

11. The igniter assembly of claim 10 wherein the interior of the igniter socket is an electrical connector, and wherein the second end of the igniter socket receives a wire that powers the electrical connector.

12. The igniter assembly of claim 10 wherein the second end of the electrode pin of the igniter is removed from the igniter socket by pulling the igniter out of the aperture of the cooktop of the cooking appliance and out of the first bracket of the orifice holder.

13. The igniter assembly of claim 10 wherein the second end of the electrode pin of the igniter is inserted into and removed from the cooktop of the cooking appliance when the cooktop is in a closed position.

14. The igniter assembly of claim 10 further comprising a spring clip having an opening, wherein the spring clip is insertable into a slot of the second bracket and removable from the slot of the second bracket to removably retain the igniter socket in the opening of the second bracket of the orifice holder, and wherein, when the spring clip is inserted into the slot and around the igniter socket, the opening of the spring clip receives at least one rib of the igniter socket.

15. The igniter assembly of claim 10 wherein the first end of the igniter socket is a female electrical connector.

16. The igniter assembly of claim 10 wherein the igniter socket is insertable and removable from the opening of the second bracket of the orifice holder in a direction transverse to an axis of the opening.

17. The igniter assembly of claim 10 further comprising a wire insertable into the second end of the igniter socket and removable from the second end of the igniter socket.

18. The igniter assembly of claim 10 further comprising one or more burners.

19. A cooking appliance, comprising:

a cooktop having an aperture therethrough, the cooktop is movable between an open position and a closed position, wherein an interior of the cooking appliance is accessible in the open position, and wherein the interior of the cooking appliance is not accessible in the closed position;

at least one orifice holder positioned beneath the cooktop of the cooking appliance;

at least one burner;

at least an igniter and an igniter socket, the igniter being removably retained by the at least one orifice holder and includes an electrode pin extending through the igniter, and wherein the electrode pin includes a first end and a second end, and the igniter socket having a first end and a second end, wherein the first end of the igniter socket is a female electrical connector, and wherein a wire is electrically coupled to the second end of the igniter socket, wherein the igniter is insertable through the aperture of the cooktop of the cooking appliance and the second end of the electrode pin of the igniter is inserted into the female electrical connector of the igniter socket when the cooktop of the cooking appliance is in the closed position, wherein the igniter is removable from the aperture of the cooktop of the cooking appliance and the first end of the igniter socket when the cooktop of the cooking appliance is in the closed position, and wherein the igniter socket includes at least one rib, and wherein the at least one orifice holder includes a spring clip engaging the at least one rib.

20. An igniter assembly for a cooking appliance, comprising:

an igniter having an igniter positioning flange and an electrode pin extending through the igniter, the electrode pin of the igniter having a first end and a second end, wherein the second end of the electrode pin is insertable and removable through an aperture of a cooktop of the cooking appliance and a first bracket of an orifice holder, and wherein the igniter positioning flange stops downward travel when inserted through the aperture of the cooktop and the first bracket;

an igniter socket having a socket positioning flange and an interior, the igniter socket further having a first end and a second end, and the igniter socket being insertable into an opening of a second bracket of the orifice holder and removable from the opening of the second bracket of the orifice holder;

wherein, when the igniter is inserted through the cooktop of the cooking appliance and through the first bracket, the first end of the igniter socket receives the second end of the electrode pin of the igniter; and wherein the first end of the igniter socket is a female electrical connector.

21. An igniter assembly for a cooking appliance, comprising:

an igniter having an igniter positioning flange and an electrode pin extending through the igniter, the electrode pin of the igniter having a first end and a second end, wherein the second end of the electrode pin is insertable and removable through an aperture of a cooktop of the cooking appliance and a first bracket of an orifice holder, and wherein the igniter positioning flange stops downward travel when inserted through the aperture of the cooktop and the first bracket;

an igniter socket having a socket positioning flange and an interior, the igniter socket further having a first end and a second end, and the igniter socket being insertable into an opening of a second bracket of the orifice holder and removable from the opening of the second bracket of the orifice holder;

wherein, when the igniter is inserted through the cooktop of the cooking appliance and through the first bracket, the first end of the igniter socket receives the second end of the electrode pin of the igniter; and wherein the igniter socket is insertable and removable from the opening of the second bracket of the orifice holder in a direction transverse to an axis of the opening.

* * * * *